US007695156B2

(12) United States Patent
Hurwitz

(10) Patent No.: US 7,695,156 B2
(45) Date of Patent: Apr. 13, 2010

(54) OMNIDIRECTIONALLY ILLUMINATED HELMET

(75) Inventor: Marni Markell Hurwitz, Far Hills, NJ (US)

(73) Assignee: Nite Glow Industries, Inc., Far Hills, NJ (US)

( * ) Notice: Subject to any disclaimer, the term of this patent is extended or adjusted under 35 U.S.C. 154(b) by 294 days.

(21) Appl. No.: 11/888,443

(22) Filed: Aug. 1, 2007

(65) Prior Publication Data

US 2009/0034238 A1 Feb. 5, 2009

(51) Int. Cl.
*F21V 21/084* (2006.01)

(52) U.S. Cl. ..... 362/106; 362/84; 2/906

(58) Field of Classification Search ..... 362/106, 362/105, 231, 234, 806, 84; 2/906; 361/752
See application file for complete search history.

(56) References Cited

U.S. PATENT DOCUMENTS

| | | | | |
|---|---|---|---|---|
| 4,891,736 | A * | 1/1990 | Gouda | 362/105 |
| 5,416,675 | A | 5/1995 | DeBeaux | 362/106 |
| 5,426,792 | A | 6/1995 | Murasko | 2/422 |
| 5,559,680 | A | 9/1996 | Tabanera | 362/106 |
| 6,007,213 | A | 12/1999 | Baumgartner | 362/106 |
| 6,113,244 | A * | 9/2000 | Baumgartner | 362/106 |
| 6,497,493 | B1 | 12/2002 | Theisen | 362/105 |
| 6,784,795 | B1 | 8/2004 | Pories et al. | 340/479 |
| 7,121,676 | B1 * | 10/2006 | Kutnyak | 362/105 |

* cited by examiner

*Primary Examiner*—Gunyoung T Lee
(74) *Attorney, Agent, or Firm*—Ernest D. Buff & Associates, LLC; Ernest D. Buff; Harry Anagnostopoulos

(57) ABSTRACT

An omnidirectionally illuminated helmet emits light along a substantial portion of the helmet surface. An interior cushion is provided for comfort and safety of the wearer's head, while an outer shell is provided for protection from impacts. This outer shell includes a plurality of transparent displays intermingled with opaque sections or regions throughout the entire surface. An electroluminescent light source substantially covers the interior cushion. The outer shell is then placed upon the electroluminescent light source in a manner that aligns the plurality of transparent displays with the light source so that the transparent displays emit light therefrom. Transparent displays are located on the entire hemispherical constructs of the outer shell, including the sides, back, front, and top, so that light is emitted from virtually the entire helmet and can be seen from any vantage point. The margin of safety provided during dusk or night-time hours when vehicles may be approaching is substantially increased by illuminating the wearer's head from all angles.

16 Claims, 4 Drawing Sheets

300
301
324
320
326
323
329
333
332
322
321
325
311
355
344
328
327
314
312

350
301
324
320
326
323
329
333
332
322
321
325
311
355
354b
354a
328
327
314
312
354c

OMNIDIRECTIONALLY ILLUMINATED HELMET

BACKGROUND OF THE INVENTION

1. Field of the Invention

The present invention relates to an illuminated helmet; and more particularly, to a helmet omnidirectionally illuminated with electroluminescent characters, indicia and/or decorations suited for use during dusk or nighttime hours for enhanced safety.

2. Description of the Prior Art

Walking, bicycling, skateboarding, roller-skating, rollerblading, or driving a motorcycle or moped during dusk or nighttime hours can be hazardous on roadways and/or in neighborhoods where automobiles are encountered. Illuminating characteristics of the automobile headlamps, generally afford an illumination range of approximately 25 to 50 feet. This illumination range can be significantly reduced by mist or fog, or bends in the road. Despite improvements to vehicle headlights, bicyclers, and the like, are oftentimes not seen by automobile drivers until the distance between the automobile and the person is small and avoiding contact becomes too late.

Several approaches devised by prior art workers attempt to provide solutions for this hazardous common activity. These approaches include 1) helmets only having reflective properties; 2) helmets having illumination means attached to an small, single area on the helmet; and 3) helmets having illumination means integrated within the helmet that provide for small amounts of illumination. In any event, none of these solutions provide a safety helmet that is highly visible from all angles via omidirectional emission of light over a substantial surface of a helmet.

Many of the safety helmets heretofore disclosed and utilized merely provide reflective means, and do not provide illumination means. Such helmets generally involve reflectors adhered to the exterior surface of the helmet that reflect light back to the source to indicate the presence of the bicyclist or motorcyclist. They do not involve illumination means within the helmet and therefore do not themselves emit light. Accordingly, a detailed discussion thereof is not required.

Various types of helmets having illumination emitting capabilities have been provided wherein an illumination means attached to the outside of a helmet/or integrated therein, but only providing illumination in the rear/or front of the helmet. Generally these types of helmets involve a light that is clipped or otherwise attached to the back or front of a helmet. For examples: U.S. Pat. No. 5,416,675 to DeBeaux discloses an automatically operated via light sensor, moving illuminated display for a helmet disposed upon the rear of the exterior of the helmet, and attached thereto as by hook and loop fastener; U.S. Pat. No. 5,426,792 to Murasko discloses an illuminated safety helmet incorporating a light panel located on the rear and front of a helmet that is capable of producing electroluminescence, and reflecting incident light that is independent of the electroluminescence function; U.S. Pat. No. 6,497,493 to Theisen discloses a safety helmet appointed with a battery-powered light having a clip appointed to be mounted on a mounting bracket on the rear section or back of the helmet; and U.S. Pat. No. 6,784,795 to Pories et al. discloses a brake and signal light system for use with a motorcycle helmet wherein a flexible housing is mounted to the helmet back and contains a receiver for signaling and at least one light source. These types of illuminated helmets merely provide illumination to the front and/or back areas of the helmet and do not provide omnidirectional illumination to the helmet. As a result, the wearer is basically only visible to vehicle drivers/others who are positioned either directly behind or in front of (via rear view mirror) the driver. As a result, drivers on the sides do not readily see the illumination, and therefore do not readily see the person wearing the helmet thus increasing the likelihood of the driver merging into or otherwise hitting the bicyclist or motorcyclist.

Even where other illuminated helmets provide illumination to more than a simple back area or front of a helmet, they still fail to provide omnidirectional lighting over the substantial area of the helmet. For example: U.S. Pat. No. 5,559,680 to Tabanera discloses an electroluminescent bicycle helmet having a foam liner, a plastic shell overlay having a transparent zone and an opaque zone, an electroluminescent lamp film located between the liner and the shell and positioned to emit light from the transparent window, and a battery and inverter, wherein the transparent window is shown as a small triangle window located on the rear and a thin band along the rim of the helmet; and U.S. Pat. No. 6,007,213 to Baumgartner discloses a helmet having light emitting diodes (LEDs) connected to a multitude of fiber optic cables assembly recessed within an inner shell, wherein an outer shell is provided having a transparent portion corresponding to the pathway involving a narrow line taken by the illuminating assembly so that light can emit past the outer shell at various light intensities. Despite the use of bands around the rim of the helmet, these devices fail to provide omnidirectional lights to substantially the entire outer surface of the helmets. Thin bands of light along the rim fail to provide light emission from the center and top of the helmets. As a result, visibility of the helmet and visa vie the wearer is compromised. Such as when a vehicle driver is in a higher-up vehicle, such as a large sports utility vehicle or a truck, and the individual wearing the helmet is a child or adult lower to the ground. As the driver's vantage point would be the top of the helmet, any light merely on the lower rim of the helmet would not be visible. As a result, the wearer of the aforementioned helmets is basically only visible to vehicle drivers/others who are positioned at a given height in relation to the wearer. Once again, drivers will not readily see the person wearing the helmet thus increasing the likelihood of the driver merging into or otherwise hitting the bicyclist or motorcyclist.

Notwithstanding the efforts of prior art workers to construct illuminated helmets that provide safety during nighttime use, there remains a need in the art for an illuminated helmet that omnidirectionally emits a significant quantum of light for optimal visibility and safety. There is a need in the art for an illuminated helmet that provides emission of light over substantially the entire surface of the helmet, so that the light is emitted in an omnidirectional manner and is visible from virtually every position. Visibility of the individual wearing the helmet would be enhanced if light was emitted, not just from a thin band circumferentially around a helmet, but from a plurality of segments located on the top, sides, back and front of a helmet.

SUMMARY OF THE INVENTION

The present invention provides an illuminated helmet that emits light along virtually the entire surface of the helmet so that light is omnidirectionally emitted from the helmet. As a result, the wearer of the helmet is visible from virtually every position and the safety of the person wearing the helmet is enhanced. Visibility of the individual wearing the helmet is enhanced as light is emitted, not just from a thin band circumferentially around a helmet or a small rear or front spot, but from a plurality of segments located on the top, sides, back and front of a helmet. This omnidirectional emission of light from the helmet is achieved by providing a plurality of transparent displays located on each of the front, back, side and top walls of the helmet.

The illuminated helmet comprises an interior cushion and an outer shell. The outer shell comprises side, back, front and top walls. A plurality of transparent displays and opaque sections are dispersed on each of the walls of the outer shell so that a substantial portion of the outer shell includes transparent displays. The illuminated helmet further comprises an electroluminescent light source located between the interior cushion and the outer shell. This electroluminescent light source is positioned under the transparent displays for emission of light through the plurality of transparent displays of the walls of the outer shell to yield omnidirectional illumination to the illuminated helmet. A battery is connected to an inverter for supplying direct current thereto. The inverter is further connected to the electroluminescent light source for supplying alternating current thereto.

The illuminated helmet is manufactured by first forming an interior cushion to accommodate and protect a person's head and forming an outer shell from a transparent plastic material. The outer shell is appointed to be placed over and fit upon the interior cushion to protect the interior cushion and the person's head during an impact. This outer shell comprises side, back, front and top walls configured to form an inner cavity and an exterior. Next, a design is selected which is appointed to be displayed on the outer shell and cut-outs of the design are created. These cut-outs are temporarily places onto chosen areas in the inner cavity of the outer shell. Chosen areas include at least one are located on each of the side, back, front, and top walls of the outer shell. A coating of an opaque pigment is applied to the inner cavity of the outer shell. Upon which the cut-outs of the designs are removed from the said inner cavity of the outer shell to yield transparent displays located on each of the side, back, front and top walls of the outer shell so that a substantial portion of the outer shell includes transparent displays. Next, an electroluminescent sheet or ribbon is cut into sections and/or shapes and these sections or shapes are aligned in relation to the interior cushion and the transparent displays on the outer shell. After alignment, the electroluminescent sections or shapes are adhered to the interior cushion. Meanwhile, a compartment is cut into the interior cushion and a battery and inverter is fit therein, and is connected to a power control and the electroluminescent sheet for providing electrical current thereto. Lastly, the transparent displays of the outer shell are aligned over the electroluminescent sections and the outer shell is attached to the interior cushion so that light is appointed for emission through the plurality of transparent displays located on the walls of the outer shell to yield omnidirectional illumination to the helmet.

BRIEF DESCRIPTION OF THE DRAWING

The invention will be more fully understood and further advantages will become apparent when reference is had to the following detailed description of the preferred embodiments of the invention and the accompanying drawings, in which.

DETAILED DESCRIPTION OF THE INVENTION

The present invention provides an omnidirectionally illuminated helmet that emits light along a substantial portion of the surface of the helmet. An interior cushion is provided for comfort and safety of the wearer's head, while an outer shell is provided for protection from impacts. This outer shell includes a plurality of transparent displays intermingled with opaque sections or regions throughout the entire surface. Electroluminescent light source is positioned on the interior cushion, so that the interior cushion is substantially covered by the electroluminescent light source. The outer shell is then placed upon the electroluminescent light source in a manner that aligns the transparent displays with the light source so that the transparent displays emit light therefrom. Transparent displays are located on the entire hemispherical constructs of the outer shell, including the sides, back, front, and top, so that light is emitted from virtually the entire helmet and can be seen from any vantage point. This increases the margin of safety in dusk or night time environments when a car is approaching by illuminating the wearer's head from all angles.

Figure 1:
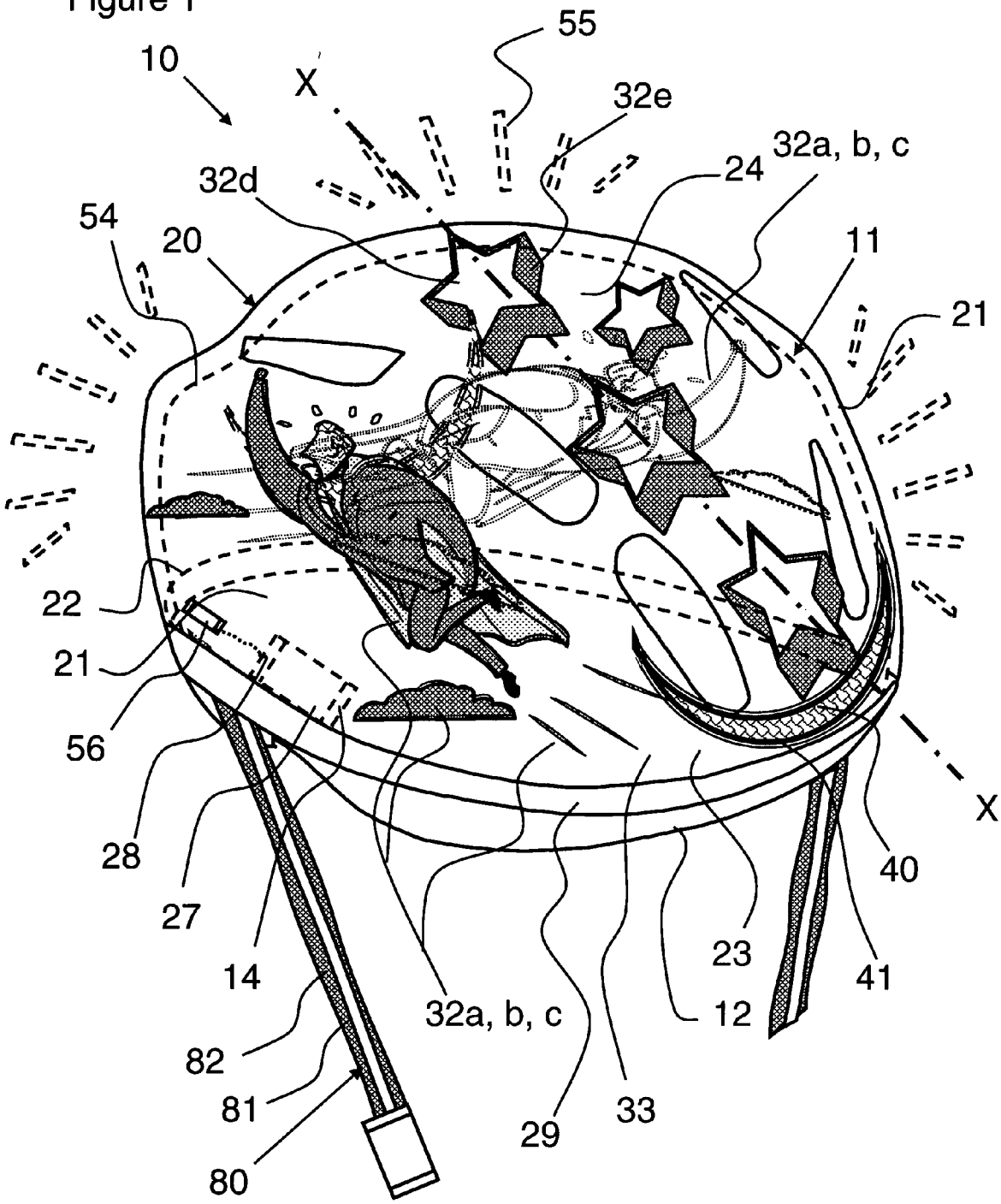
FIG. 1 is a schematic view of the omnidirectionally illuminated helmet showing lighted regions, including side, front, back and top walls of the outer shell.

FIG. 1 is a schematic view of the omnidirectionally illuminated helmet shown generally at 10. The illuminated helmet comprises an interior cushion 11 and an outer shell 20. The outer shell 20 comprises side 21, back 22, front 23 and top 24 walls. A plurality of transparent displays 32 (32*a*-32*d* . . . 3*dn*) and opaque sections 33 (33*a*-33*n*) are dispersed on each of the walls, 21, 22, 23 and 24, of the outer shell 20 so that a substantial portion of the outer shell 20 is covered with transparent displays 32*a*-32*n* intermingled with opaque sections 33*a*-33*n*. These transparent displays 32*a*-32*n* can be a plethora of shapes, sizes, designs, characters, indicia, and so on. Herein, the transparent displays 32*a*-32*d* . . . 3*dn* are shown as a super hero 32*a* flying through the sky 32*b*, clouds 32*c* and up into the stars 32*d*. For example, such as would be a design a young child would be interested in wearing. Transparent displays 32*a*-32*n* may be specific characters and advertise various organizations. Moreover, opaque sections 33*a*-33*n* and transparent designs 32*a*-32*n* may be of any size, and may merely be speckles located along the entire surface of the helmet 10 to look like an egg or the like with light radiating from every angle along the hemispherical shaped outer shell 20. A retroreflective sheet 40 thermally bonded to a woven or knitted strip 41 may be bonded to outer shell 20 to provide reflective properties as well as illumination to illuminated helmet 10.

The illuminated helmet 10 further comprises an electroluminescent light source 54 located between interior cushion 11 and outer shell 20. Interior cushion 11 is substantially covered by the electroluminescent light source 54 (for further elaborations regarding placement of the electroluminescent light source 54 see discussion on FIGS. 3*a* and 3*b*). Electroluminescent light source 54 is positioned under the transparent displays 32 (32*a*-32*d*) for emission of light 55 through the plurality of transparent displays 32 (32*a*-32*d*) of side 21, back 22, front 23 and top 24 walls of outer shell 20 to yield omnidirectional illumination to illuminated helmet 10. A battery 27 is connected to an inverter 28 for supplying direct current thereto. Inverter 28 is further connected to electroluminescent light source 24 for supplying alternating current thereto. The electroluminescent light source 54 may be a continuous light emission, blinking, or gradient style so that the transparent displays 32 light up in a timed, cascading sequence. Interior cushion 11 comprises a box cut-out 14 for housing battery 27 and inverter 28 therein. Box cut-out 14 allows battery 27/inverter 28 to lie flush within interior cushion 11. Preferably, an on-off power switch for activating/deactivating current supply to inverter 28 and visa vie electroluminescent light source 54. Most preferably, a light sensor 56 is provided to engage battery 27 for automatically activating/deactivating current supply to inverter 28 and visa vie electroluminescent light source 54. Helmet 10 may be a bicycle helmet, a motorcycle helmet, or any type of safety helmet appointed to be worn. Other sports utilizing helmets include skateboarding, roller skating, rollerblading, skiing, hockey and/or football (wherein a teams decal can be designed in the transparent display and lit-up by the electroluminescent light source), or other sports and activities. Alternatively, fiber optics may be utilized in place of electroluminescent lighting. In such an event an LED light would be provided within the interior cushion 11 and fiber optic cables associated with the LED would run along a substantial portion of interior cushion 11 positioned and aligned with transparent displays 32*a*-32*n* of outer shell 20.

Illuminated helmet 10 is shown herein with outer shell 20 as being substantially elliptical in shape and having a rim 29 circumferentially thereupon. Correspondingly, interior cushion 11 comprises a lower perimeter 12, a portion of which aligns with rim 28 of outer shell 20. Electroluminescent light source 54 is further placed upon lower perimeter 12 under rim 28 of outer shell 20. Rim 28 is transparent, and preferably coated with a transparent pigment, to further emit light circumferentially out of outer shell 20. Thereby further enhancing safety accorded to the wearer. Transparent displays 32 (32*a*-32*d*) and rim 28 are each preferably tinted or painted with at least one transparent pigment to allow light to pass through in a colored ornamental manner. In turn, opaque sections 33*a*-33*n* are preferably tinted or painted with at least one opaque pigment to prevent light from passing through while providing ornamentation to helmet 10. Layers of transparent pigment can be used to form the opaque sections 33*a*-33*n*. Additionally, opaque sections 33*a*-33*n* and transparent displays 32*a*-32*n* may be constructed within the plastic of the outer shell 20 during the molding process, rather than by coating or painting after outer shell 20 is formed. Transparent displays 32 (32*a*-32*n*) are preferably shaped of characters or other ornamental designs, and may be illuminated in their entirety, as is generally herein shown in FIG. 1, transparent displays 32*a*-32*d*. On the other hand, transparent displays 32 may comprise transparent outlines as shown with star transparent display outlines 32*e*, wherein opaque shapes/or lines are used so that light emits through transparent outlines 32*e*.

Omnidirectionally illuminated helmet 10 preferably further comprises illuminated chin straps 80 appointed for securing helmet 10 to a person's head. Optional illuminated chin straps 80 are (preferably) made up of reflective fibers/or otherwise comprise reflective strips 81, and include an electroluminescent cable/ribbon/sheet 82 integrated therein, which is further powered by battery 27 via inverter 28. Enhanced safety is provided by way of the optional illuminated chin straps 80 by further radiating light from the wearer's cheeks and chin. As a result, motorists can readily ascertain that the omnidirectional light they are seeing is a helmet as the helmet and chin straps outline the wearer's head and face. The electroluminescent cable/ribbon/sheet 82 integrated within the fibers 81 is shown herein as outlining the sides of fibers 81, but electroluminescent sheet 82 may be placed in any manner in relation to fibers 81 and may even be a cut-out design or shaped with a logo. Preferably, electroluminescent cable/ribbon/sheet 82 is integrated within a substantial portion of fiber 81 so that illuminated chin straps 80 are substantially lighted during dusk or night and provide enhanced lighting of the wearer's cheeks and chin, and overall face.

Figure 2:
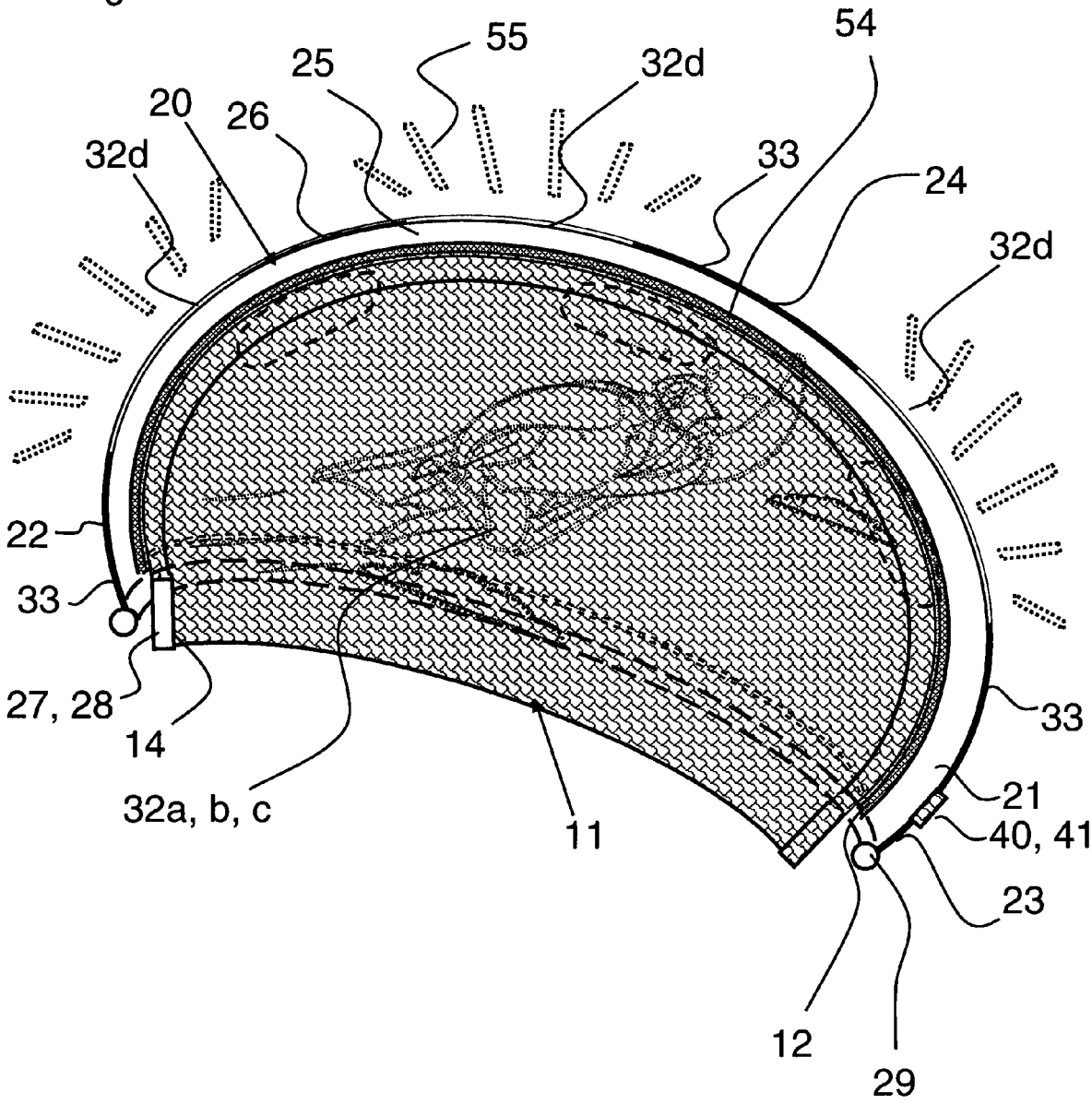
FIG. 2 is a cross-sectional side view taken along line X of FIG. 1, showing the transparent displays and opaque section as well as the electroluminescent sheet covering a substantial portion of the interior cushion and visa vie the outer shell's inner cavity.

FIG. 2 is a cross-sectional side view taken along line X of FIG. 1, showing the transparent displays and opaque section as well as the electroluminescent sheet covering a substantial portion of the interior cushion and visa vie the outer shell's inner cavity. The omnidirectionally illuminated helmet 10 is constructed by forming an outer shell 20 from a sturdy, transparent plastic material suitable to protect a wearer's head from impact. Side 21, back 22, front 23 and top 24 walls of outer shell 20 are configured to form an inner cavity 25 and an exterior 26. Designs are selected for forming transparent displays 32*a*-32*n* (herein showing cross-sectional views of stars 32*d* and a view of 32*a, b* and *c* of FIG. 1). When constructing outer shell 20, cut-outs of the designs are created and are temporarily placed on each of the side 21, back 22, front 23 and top 24 walls of outer shell 20. Preferably, a coating of an opaque pigment is applied to inner cavity 25 of outer shell 20, and the cut-outs are removed to reveal the transparent displays 32*a*-32*n* on a substantial portion of outer shell 20. These areas (transparent displays 32*a*-32*n*) can be decorated or applied with different transparent pigments to show color or the like. Next, an electroluminescent sheet or ribbon 54 is cut into sections and/or shapes and these sections or shapes are aligned in relation to interior cushion 11 and transparent displays 32*a*-32*n* on outer shell 20. After alignment, the electroluminescent sections or shapes 54 are adhered to interior cushion 11.

Meanwhile, a compartment or box-like cut out 14 is cut into interior cushion 11 to accommodate a battery 27 and inverter 28 therein, and is connected to a power control and electroluminescent sheet 54 for providing electrical current thereto. Lastly, transparent displays 32*a*-32*n* of outer shell 20 are aligned over the electroluminescent sections 54 and outer shell 20 is attached to interior cushion 11 so that light 55 is appointed for emission through the plurality of transparent displays 32*a*-32*n* located on side 21, back 22, front 23 and top 24 walls of outer shell 20 to yield omnidirectional illumination to the helmet 10.

Figure 3A:
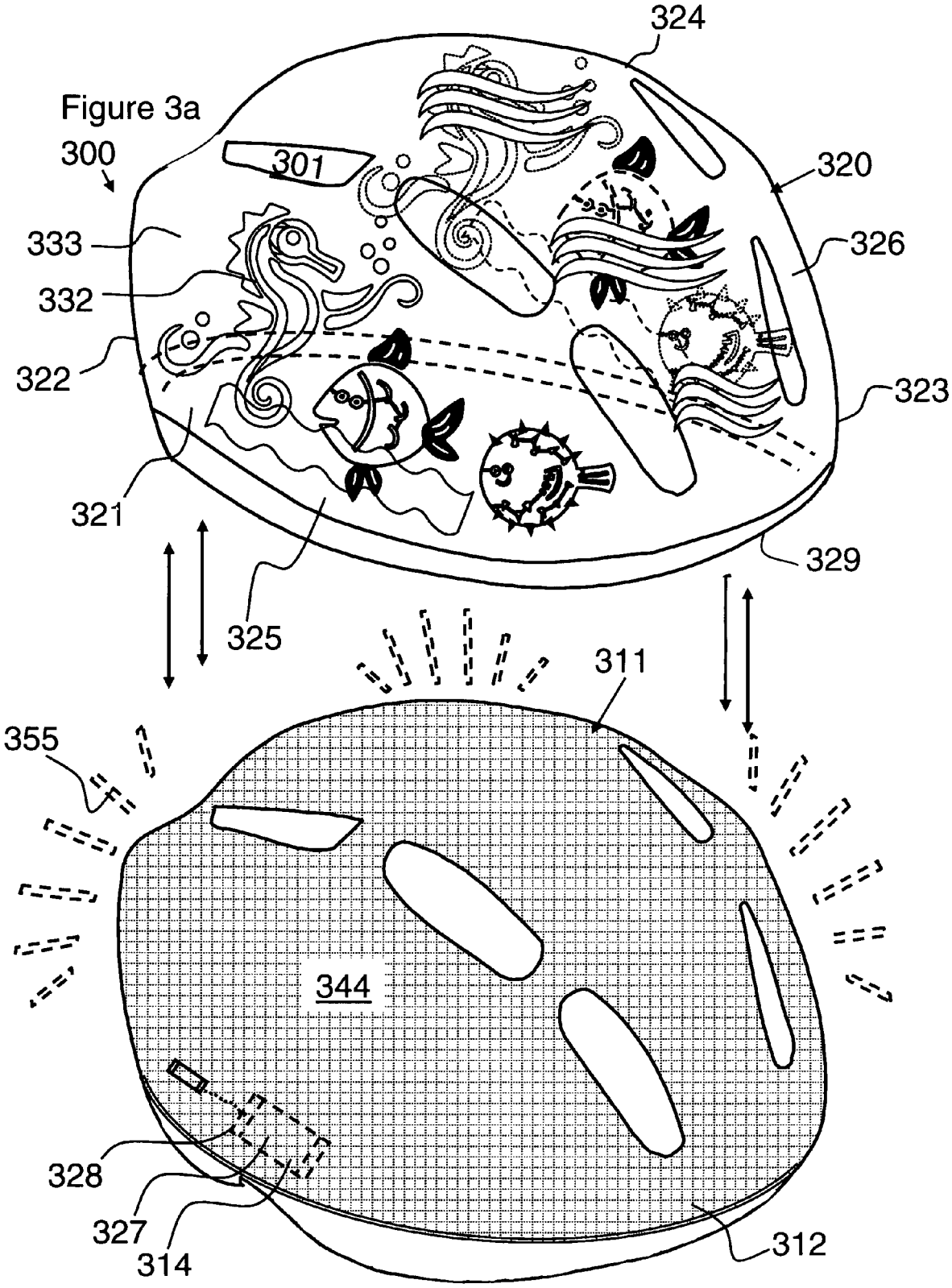
FIG. 3*a* is a schematic view showing the omnidirectionally illuminated helmet being assembled, wherein an electroluminescent sheet covers a substantial portion of the interior cushion.
Figure 3B:
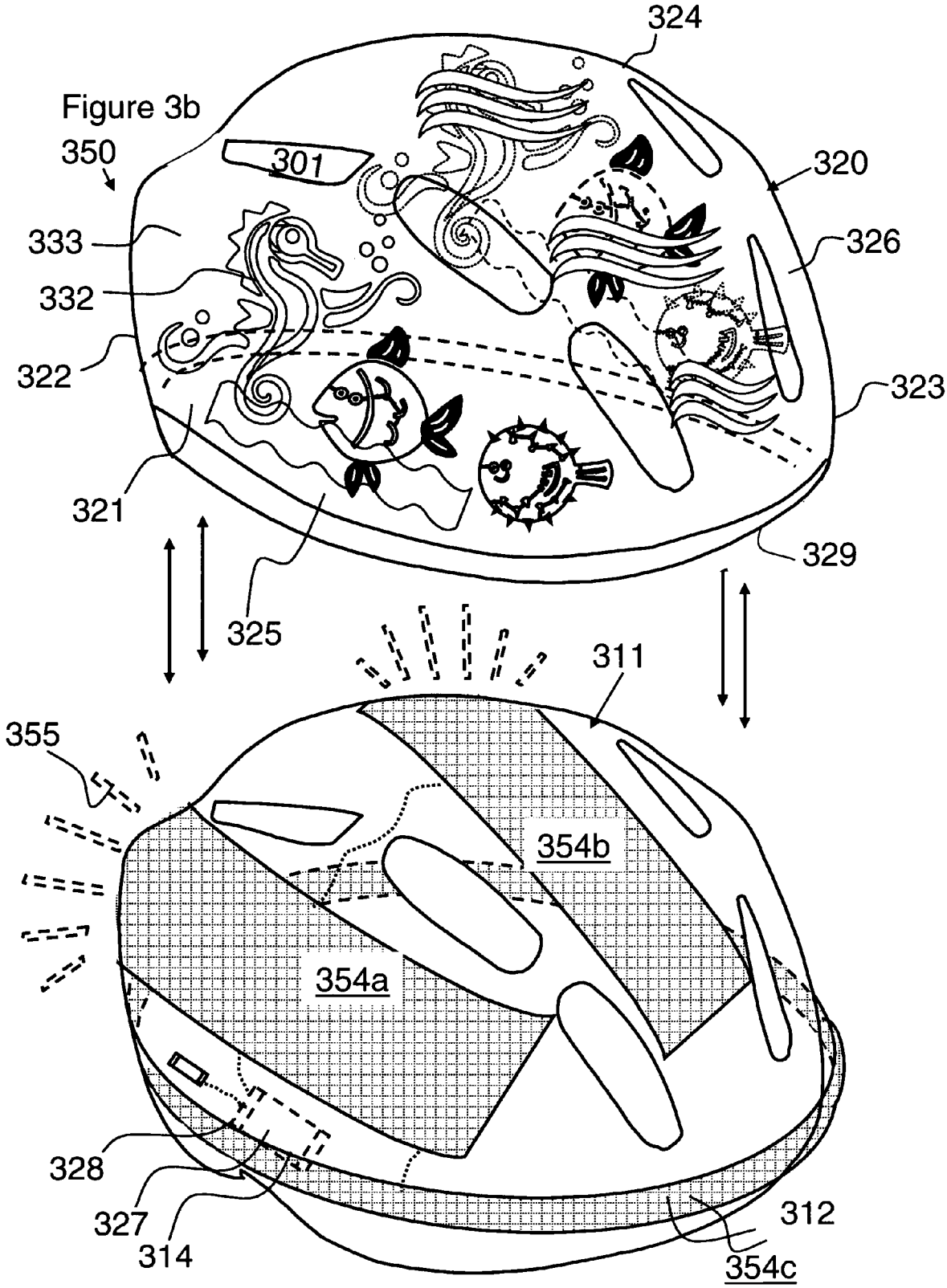
FIG. 3*b* is a schematic view showing the omnidirectionally illuminated helmet being assembled, wherein electroluminescent sheets have been cut to align under the transparent displays of the outer shell and have been arranged to cover a substantial portion of the interior cushion.

FIGS. 3*a* and 3*b* are schematic views showing an omnidirectionally illuminated helmet being assembled. FIG. 3*a* shows the helmet being constructed with substantially the entire interior cushion being covered with an electroluminescent sheet or the like, shown generally at 300. FIG. 3*b* shows the helmet being constructed with a substantial portion of the interior cushion being covered with electroluminescent sheets having been cut to align under the transparent displays of the outer shell, shown generally at 350. Illuminated helmet 300, 350 comprises interior cushion 311, an outer shell 320 having side 321, back 322, front 323 and top 324 walls generally constructed to form a hemispherical shape having an inner cavity 325 and an exterior surface 326. A plurality of transparent displays 332*a*-332*n* and opaque sections 333*a*-333*n* are dispersed on each of side 321, back 322, front 323 and top 324 walls of the outer shell 320 so that a substantial portion of the outer shell 320 is covered with transparent displays 332*a*-332*n* intermingled with opaque sections 333*a*-333*n*. These transparent displays 332*a*-332*n* can be a plethora of shapes, sizes, designs, characters, indicia, and so on, and herein are shown as an ocean scene.

Illuminated helmet 300, 350 is shown herein with outer shell 320 having a rim 329 circumferentially thereupon, which aligns with a lower perimeter 312 of interior cushion 311. Helmet 300, 350 generally includes apertures 301 constructed therein. In FIG. 3*a* the electroluminescent light source 344 is shown as an electroluminescent sheet cut to conform to interior cushion 311. In FIG. 3*b* the electroluminescent light source 354 is shown as an electroluminescent sheet/ribbon/cables 354*a*-354*n* cut into sections or portions and placed to extend over top-front-back center of interior cushion 311 in an aligned position with transparent displays 332*a*-332*n* of outer shell 320 for emitting light 355. Box cut-out 314 is provided for housing a battery 327 connected to an inverter 328 further connected to electroluminescent light source 344, 354 for supplying current thereto. The electroluminescent light source 344, 354 may be a continuous light emission, blinking, or gradient style so that the transparent displays 332*a*-332*n* light up in a timed, cascading sequence. The electroluminescent sheet 344/354*a*-354*n* has a width ranging between 2 to 27 inches and height ranging from 6 to 27 inches and can be cut into an array of designs and shaped to correspond to each transparent display 332*a*-332*n* of outer shell 320. Alternatively, electroluminescent light source 354*a*-354*n* may comprise electroluminescent cable and/or ribbon positioned on interior cushion 311 in alignment with transparent displays 354*a*-354*n* of outer shell 320. In any case, the electroluminescent cable and/or ribbon 344/354*a*-354*n* substantially covers interior cushion 311 and transparent displays 354*a*-354*n* substantially cover outer shell 320 so that illuminated helmet 300, 350 omnidirectionally emits a substantial amount of light. Wherein electroluminescent cable and/or ribbon is utilized, it preferably has a width of 0.025 to 24 inches. Electroluminescent cables, ribbons, and/sheets can come in an array of sizes and colors, such as Royal Blue, Electric Yellow, Gleaming White, Blood Red, Lightning Green, Deep Purple, Ice Blue, and Bright Orange. The electroluminescent cables, ribbons and sheets can be readily cut to the desired shape or size. After cutting the electroluminescent cable, ribbon or sheet to the desired size or shape, the cut sheet/ribbon is connected to the inverter and visa vie the battery and power controller.

Having thus described the invention in rather full detail, it will be understood that such detail need not be strictly adhered to, but that additional changes and modifications may suggest themselves to one skilled in the art. For example, light emission can be made responsive to the quantum of light extant in the environment wherein the helmet resides. This feature is readily achieved by embedding or otherwise associating a light sensitive switch with the helmet structure. The light sensing feature can be coupled with a motion detecting device such as an accelerometer or the like, which preserves light emission while the helmet is undergoing changes in motion. A time delay circuit, such as a resistance/capacitance circuit, can be further associated with the light sensing feature, to allow for continued light emission during a preselected time period after motion of the helmet has ceased. Upon conclusion of the preselected time period, the light emission is discontinued. Light is thereby emitted automatically when the helmet is placed in service and discontinued after being taken out of service, such as would be the case when the helmet is stored in a closet or the like for future use. Battery life is preserved and automatically triggered light emission in dimly lit surroundings is assured. The helmet's visibility is virtually guaranteed, according increased safety to helmet wearers. Such features are intended to fall within the scope of the invention as defined by the subjoined claims.

What is claimed is:

1. An illuminated helmet, comprising:

a. an interior cushion;

b. an outer shell comprising side, back, front and top walls, said outer shell having a plurality of transparent displays and opaque sections dispersed on each of said walls of said outer shell so that a substantial portion of said outer shell is covered with said transparent displays;

c. an electroluminescent light source comprising an electroluminescent sheet is provided and located between said interior cushion and said outer shell positioned under said transparent displays for emission of light through said plurality of transparent displays of said walls of said outer shell, said electroluminescent sheet substantially covering the entire outer surface of said interior cushion and being aligned with said transparent displays to provide omnidirectional illumination to said illuminated helmet;

d. a battery being connected to an inverter for supplying direct current thereto, said inverter being connected to said electroluminescent light source appointed for supplying alternating current thereto; and e. said interior cushion comprises a cut-out for housing said battery and inverter therein.

2. An illuminated helmet as recited by claim 1, wherein said outer shell is substantially elliptical in shape and comprises a rim circumferentially thereupon and said interior cushion comprises a lower perimeter, wherein said rim is a transparent rim and wherein said electroluminescent light source is further located along said perimeter so that said light circumferentially omnidirectionally illuminates from said rim of said outer shell.

3. An illuminated helmet as recited by claim 1, wherein said transparent displays are tinted or painted with at least one transparent pigment to allow light to pass through and said opaque sections are tinted or painted with at least one opaque pigment to prevent light from passing through.

4. An illuminated helmet as recited by claim 1, wherein said transparent displays are shaped of characters or other ornamental designs.

5. An illuminated helmet as recited by claim 1, wherein said transparent displays comprise transparent outlines of opaque shapes so that light emits through said transparent outlines.

6. An illuminated helmet as recited by claim 1, wherein said electroluminescent sheet substantially covers said interior cushion and said transparent displays substantially make-up said outer shell so that said illuminated helmet omnidirectionally emits a substantial amount of light.

7. An illuminated helmet as recited by claim 1, wherein each of said electroluminescent sheets has a width ranging between 2 to 27 inches and height ranging from 6 to 27 inches, and said electroluminescent sheets are capable of being cut into an array of designs and shaped to correspond to each of said transparent displays on said walls of said outer shell.

8. An illuminated helmet as recited by claim 1, wherein said electroluminescent light source comprises an electroluminescent cables an electroluminescent ribbon, or both an electroluminescent cable and ribbon, positioned on said interior cushion in alignment with said transparent displays located on said walls of said outer shell.

9. An illuminated helmet as recited by claim 8, wherein said electroluminescent cable or ribbon substantially covers said interior cushion and said transparent displays substantially cover said outer shell so that said illuminated helmet omnidirectionally emits a substantial amount of light.

10. An illuminated helmet as recited by claim 8, wherein each of said electroluminescent cable or ribbon has a width of 0.025 to 24 inches.

11. An illuminated helmet as recited by claim 1 comprising a retroreflective sheet thermally bonded to a woven or knitted strip which in turn is bonded to said outer shell to provide reflective properties as well as illumination to said illuminated helmet.

12. An illuminated helmet as recited by claim 1 comprising an on-off power switch for activating/deactivating said current supply to said inverter and said electroluminescent light source.

13. An illuminated helmet as recited by claim 1 comprising a light sensor engaged with said battery for automatically activating/deactivating said current supply to said inverter and said electroluminescent light source.

14. An illuminated helmet as recited by claim 1 wherein said helmet is a bicycle helmet.

15. An illuminated helmet as recited by claim 1 wherein said helmet is a motorcycle helmet.

16. An illuminated helmet as recited by claim 1 comprising helmet chin straps for securing said helmet to a person's head, wherein said chin straps comprise reflective fibers and electroluminescent cable integrated therein further powered by said battery via said inverter.

* * * * *